US009247801B2

(12) United States Patent
Presche

(10) Patent No.: US 9,247,801 B2
(45) Date of Patent: Feb. 2, 2016

(54) RECEPTACLE

(75) Inventor: Martin Presche, Dinklage (DE)

(73) Assignee: RPC Bramlage GmbH, Lohne (DE)

( * ) Notice: Subject to any disclaimer, the term of this patent is extended or adjusted under 35 U.S.C. 154(b) by 175 days.

(21) Appl. No.: 13/634,370

(22) PCT Filed: Mar. 15, 2011

(86) PCT No.: PCT/EP2011/053843

§ 371 (c)(1),
(2), (4) Date: Sep. 12, 2012

(87) PCT Pub. No.: WO2011/113811

PCT Pub. Date: Sep. 22, 2011

(65) Prior Publication Data

US 2013/0004228 A1 Jan. 3, 2013

(30) Foreign Application Priority Data

Mar. 15, 2010 (DE) ..... 20 2010 000 381 U

(51) Int. Cl.
*A46B 11/00* (2006.01)
*A45D 40/26* (2006.01)

(52) U.S. Cl.
CPC ..... *A45D 40/268* (2013.01)

(58) Field of Classification Search
CPC ..... A45D 40/268
USPC ..... 401/121, 122, 126; 132/218
See application file for complete search history.

(56) References Cited

U.S. PATENT DOCUMENTS

| | | | | |
|---|---|---|---|---|
| 4,241,743 | A * | 12/1980 | Schnabel et al. | 401/122 |
| 4,407,311 | A * | 10/1983 | Gueret | 401/122 |
| 4,433,928 | A | 2/1984 | Kingsford | |
| 4,609,300 | A * | 9/1986 | Robert | 401/122 |
| 6,168,334 | B1 | 1/2001 | Fordham | |
| 6,502,584 | B1 | 1/2003 | Fordham | |
| 6,503,487 | B1 * | 1/2003 | Ohba | 424/64 |
| 7,325,550 | B2 | 2/2008 | Eckers et al. | |
| 7,455,468 | B2 * | 11/2008 | Gueret | 401/126 |
| 8,007,191 | B2 * | 8/2011 | Gueret | 401/129 |
| 8,292,531 | B2 * | 10/2012 | Rauschert et al. | 401/129 |
| 2005/0034740 | A1 | 2/2005 | Eckers et al. | |
| 2010/0104348 | A1 | 4/2010 | Rauschert et al. | |

FOREIGN PATENT DOCUMENTS

| | | |
|---|---|---|
| DE | 196 42 720 | 4/1998 |
| DE | 101 02 219 | 7/2002 |
| DE | 10 2008 052895 | 2/2010 |
| EP | 1 066 771 | 1/2001 |
| GB | 2312617 | 11/1997 |

OTHER PUBLICATIONS

International Search Report of PCT/EP2011/053843, date of mailing May 31, 2011.

* cited by examiner

*Primary Examiner* — Jennifer C Chang
(74) *Attorney, Agent, or Firm* — Collard & Roe, P.C.

(57) ABSTRACT

A receptacle for a liquid or paste-like product, in particular a cosmetic product, has a removal part and a storage space for the product. The removal part is introducible into the storage space and is withdrawable by being brought through a wiping device. In order for the receptacle to allow a favorable state of loading with product for the withdrawn removal part, as far as possible in accordance with individual preferences, the wiping device can be altered by action from outside with regard to a wiping effect.

8 Claims, 9 Drawing Sheets

15
19
4
20
14
13
16
21
7
8
3
2
5
12
11

RECEPTACLE

CROSS REFERENCE TO RELATED APPLICATIONS

This application is the National Stage of PCT/EP2011/053843 filed on Mar. 15, 2011, which claims priority under 35 U.S.C. §119 of German Application No. 20 2010 000 381.4 filed on Mar. 15, 2010, the disclosure of which is incorporated by reference. The international application under PCT article 21(2) was not published in English.

The invention relates to a receptacle for a liquid or paste-like product, in particular a cosmetic product, the receptacle having a removal part and a storage space for the product, the removal part being introducible into the storage space and being withdrawable by being brought through a wiping device.

Receptacles of this kind are already known in a variety of configurations, in particular in the form of mascara receptacles with applicators. Reference is made for example to GB 2312617A, DE 196 42 720 A1 and EP 1066 771 B1 (U.S. Pat. No. 6,502,584 B1 and U.S. Pat. No. 6,168,334 B1). In regard to a removal part, which is also to be designated as an applicator, reference is made for example to DE 101 02 219 A1 (US 20050034740 A1).

A receptacle is known from DE 10 2008 052859 B3, in which the wiping device is formed by a wiper part, the inner opening of which can be changed as result of axial compression. The wiper part is connected in a rotatably fixed manner both to the storage receptacle and to the adjustment part.

In the case of the subject of U.S. Pat. No. 4,433,928 A, in the embodiment of FIG. 8, the part that is passed through is connected on the underside to the storage space part in a rotationally-fixed manner, while at the upper end, it is displaced in rotation relative to a mouth of the storage space part. There is however no axial movability.

U.S. Pat. No. 4,609,300 A, mentioned finally also as prior art, has in this sense also only a part that is passed through, which is fixedly connected both to the storage space part and to an upper part. The opening that is passed through can be varied by way of a clamp that can be altered as to its opening. Axial movability relative to an adjustment part, with at the same time rotationally-fixed interaction with the adjustment part, is however also not known from this.

In order to prevent dripping-off or falling-off of product from the withdrawn removal part or applicator, it is known to provide a wiping device in the exit region of the storage receptacle. On the other hand, it is frequently observed that a wiping device of this kind develops an action which is too great or too little.

Starting from the state of the art set out, the invention is concerned with the problem of providing a receptacle, as set out at the beginning, which allows a favorable state of loading with product of the withdrawn removal part, as far as possible in accordance with individual preferences.

This problem is solved by the subject matter of Claim 1, it being specified therein that the wiping device has a part which is passed through, the part being connected on the one hand to the storage space part and on the other hand to the adjustment part, but is connected to one of the parts, preferably the adjustment part, only in a manner which is rotationally fixed but is axially displaceable. The wiping device which can be altered by action from the outside in respect of its wiping effect enables adaptation to individual requirements during withdrawal of product. The user can, without having to access the interior of the receptacle and having to change for example a part, regulate the wiping action according the user's needs. In this way, there can also be achieved in principle a different [wiping] action in regard to different products, or this may optionally be pre-set by the manufacturer.

By virtue of the part that is passed through being connected to one of the parts, preferably the adjustment part, only in a manner which is rotationally fixed but is axially displaceable, the part that is passed through can be turned only at one of its end regions relative to the other end region, but at the same time, it can move axially in the course of a reduction in length that accompanies this turning. If, as is preferred, it is formed in the shape of a sleeve, especially of elastic material, there can therefore take place a constriction or tapering in the middle region of the part that is passed through, in dependence on the relative rotation.

It is preferred for the opening to be formed by a cylindrical region which is passed through. This is in particular a cylinder, the elongate axis of which extends in the direction of movement of the removal part. The wiping action can thus be extended over a certain longitudinal extent. It is preferred for the constricting to be effected by turning the region which is passed through about a longitudinal axis of the region which is passed through.

It is also preferred for the region which is passed through to be formed from an elastic material. For example, this may be a rubber-like material. Particularly preferred, in connection with plastics injection-molded parts, of which the receptacle preferably consists, is a thermoplastic elastomer.

Preferred furthermore also is for the region which is passed through to be formed by a separate part that is passed through. The part that is passed through may however already be connected to a further part, during manufacture, for example by manufacture using the two-component injection-molding method. It may however also be welded or glued for example to one or more further parts.

The part that is passed through may in particular be sleeve-like, for example a sleeve consisting of a rubber-like [material] or a TPE. By this, the adjustment of the wiping action may be achieved by a base region of the sleeve being turned relative to a head region of the sleeve. In this way, a constricting comes about in the middle region, which provides the desired narrowing of the free cross-section of the through passage.

The connection to the storage space part may be fixed, in particular in the circumferential and axial directions, for example by manufacture as already stated using the two-component injection-molding method.

Moreover, it is also preferred for the adjustment part to be latchingly displaceable relative to the storage space.

The invention is explained further below with reference to the appended drawings, which, however, only show an exemplary embodiment. The figures show the following:

Figure 1:
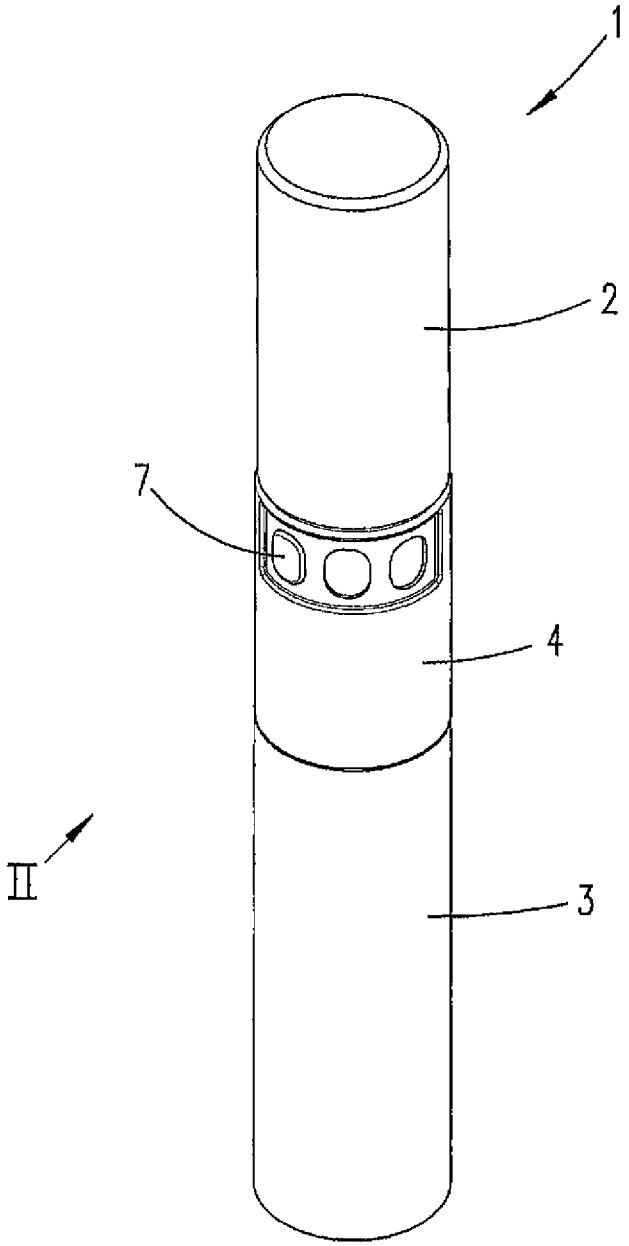
FIG. 1 shows a perspective view, from the outside, of the entire receptacle.
Figure 2:
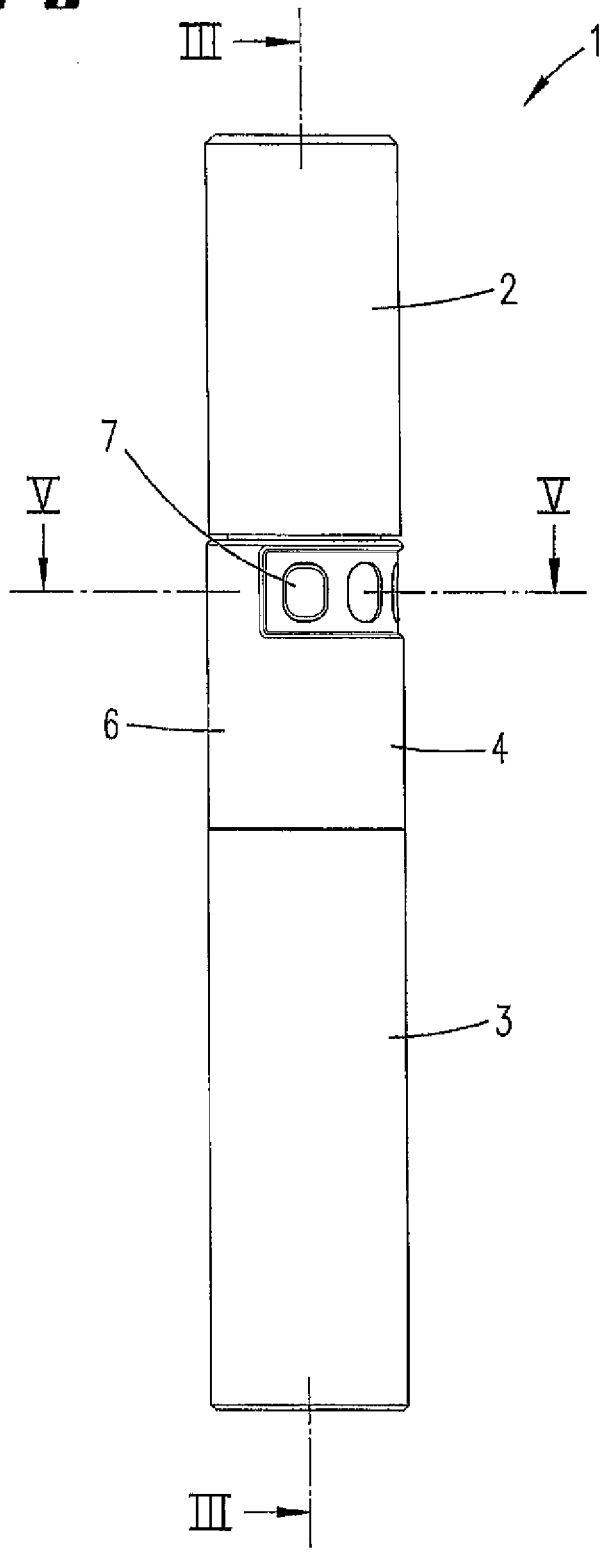
FIG. 2 shows a side view of the receptacle.
Figure 3:
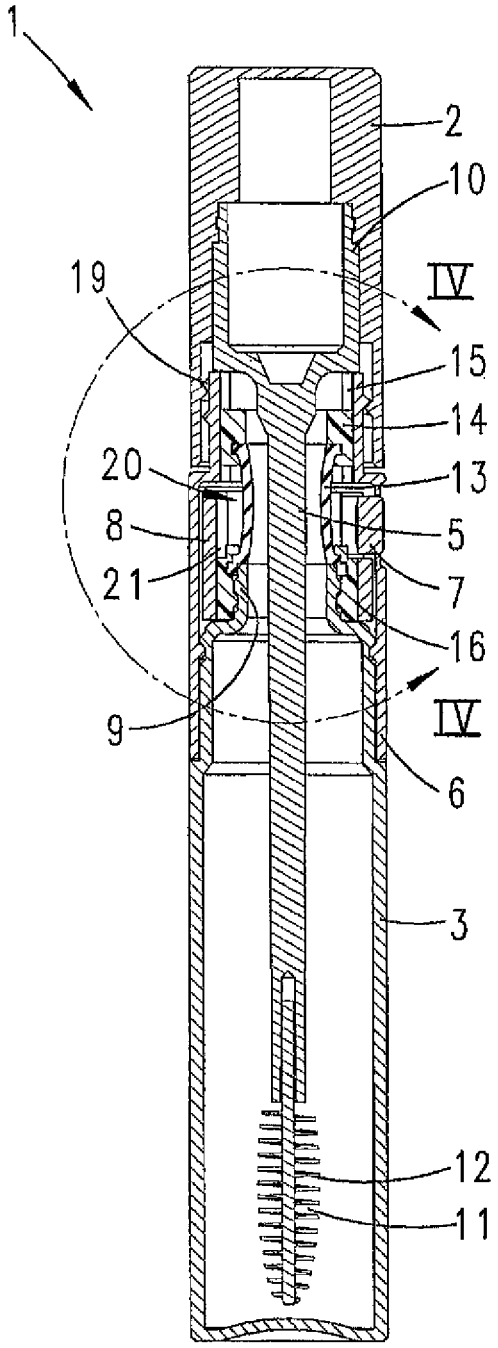
FIG. 3 shows a longitudinal cross-section through the receptacle according to FIG. 1 and FIG. 2, sectioned along the plane III-III in FIG. 2.
Figure 4:
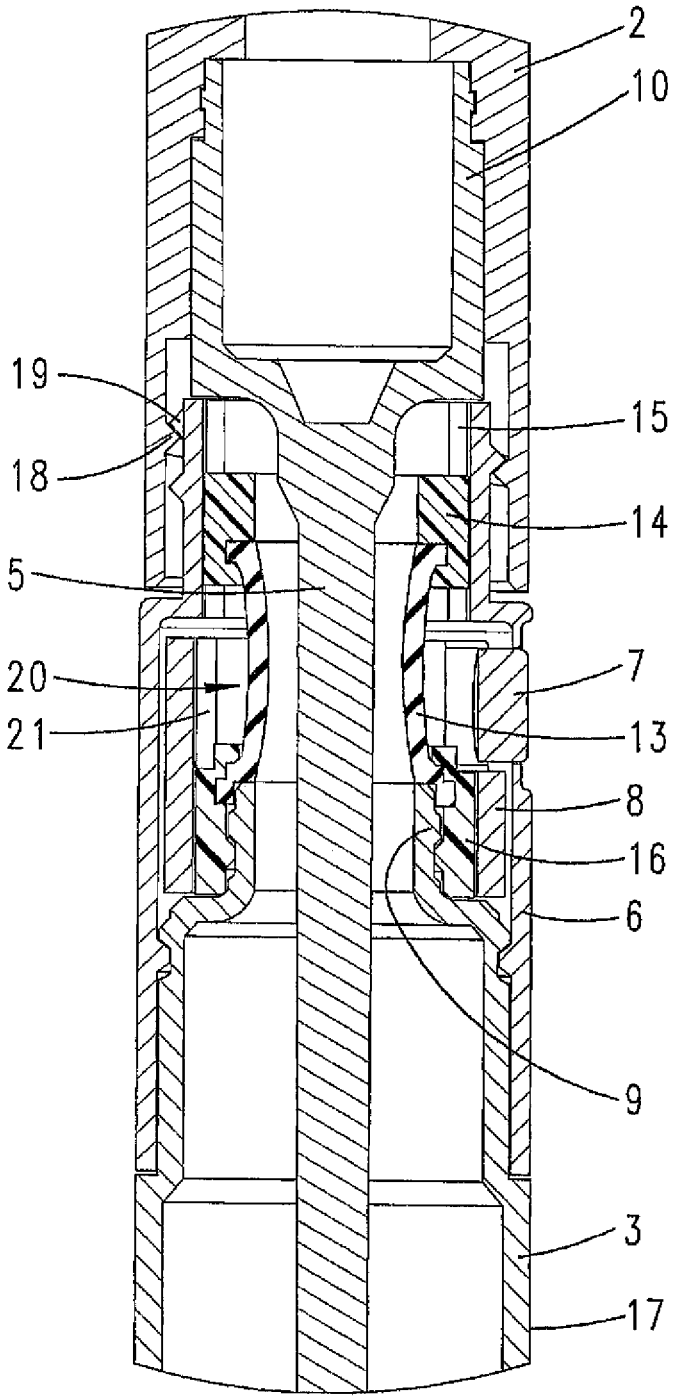
FIG. 4 shows the region IV-IV in FIG. 3 in enlarged detail.
Figure 5:
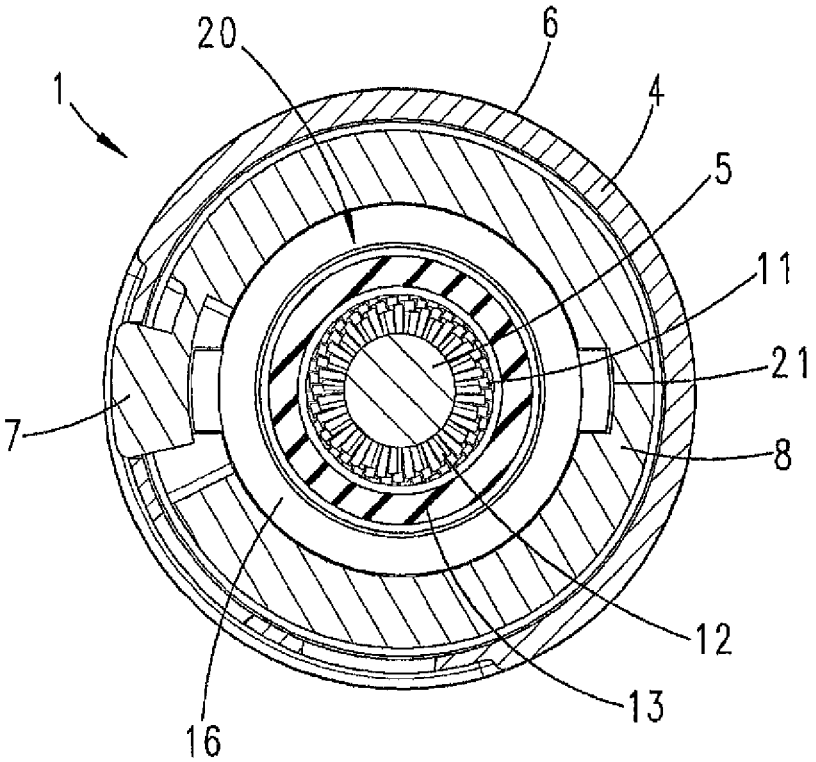
FIG. 5 shows a cross-section through the item according to FIG. 1, sectioned along the line V-V.

Shown and described, as a whole in a realization as a mascara applicator 1, is a receptacle that has a removal part, which basically consists of a protective cap 2, a storage part 3, an adjustment part 4 and a removal part 5.

An overall cylindrical configuration of the receptacle is preferred. The adjustment part 4 can be arranged to be aligned with the storage part 3 and the protective cap 2 and/or be disposed between these in the vertical direction.

As is shown in particular from the cross-sectional illustrations of FIGS. 3, 4, and 6 to 8, the storage part 3 is provided with a rotatably-connected actuating part 6, which interacts with respect to a latching part, for example a latching cam 7, which is rotationally-fixed to the storage part 3 but is however preferably displaceable transversely to a longitudinal axis of the receptacle, thus is displaceable inwardly. As is to be seen for example from the exploded illustration of FIG. 9, the latching part, preferably the latching cam 7, is fixed, preferably by being snapped-on, to a latching cam part 8, which is fixedly connected to a neck region 9 of the storage part 3, in particular and in any case in a rotationally-fixed manner.

In the non-use condition, the removal part 5 is pushed into the storage part 3. The removal part 5 has on the one hand a handle end 10 and on the other hand a removal tip 11. The removal tip 11 is preferably provided with bristles 12.

Furthermore, the protective cap 2 engages over the removal part 10.

A wiping device 20 is disposed adjacent to the neck region 9 of the storage part 3 in the removal direction. The wiping device 20 consists of a wiping part 13 which is preferably sleeve-like and is preferably an elastomer part. It is preferably basically cylindrical in shape. The wiping part 13 can be manufactured to have a wall which extends concavely in cross-section, as seen from the outside, as is to be seen from FIG. 3, which shows a starting position, the wall accordingly leading to a certain constriction in the interior.

The wiping part 13 is provided with a mounting portion 14 at one end, preferably [made] by the two component injection molding method, the mounting portion being accommodated in a guide 15 so as to be vertically movable. Depending on the setting of the wiping device, see for example also by comparison with FIG. 6 to FIG. 8, the mounting portion travels vertically downwards. While the wiping part 13 preferably consists of a soft material, in particular a TPE, the mounting portion 14 preferably consists of a hard plastics material.

At its base, thus associated with the storage part 3, the wiping part 13 is also preferably connected to a base part 16 of hard plastics material, in particular also produced by the two component injection molding method. By means of this base part 16, the wiping part is fixedly connected to the neck 9, in particular in any case in a rotationally-fixed manner. The neck region 9 is formed to taper correspondingly, so that the base part 16 and the latching cam part 8 which is in the embodiment furthermore also arranged to be radially outward with respect to the neck region, and the actuating part 6 that engages over the neck region, fit into a cylindrical outer surface 17 of the storage part 3.

The latching cam part 8 is likewise connected to the storage part 3 in a rotationally-fixed manner, in the embodiment portion by means of the base part 16.

The protective cap 2 is connected to the removal part 5 at least to be rotationally fixed to it. The protective cap 2 is moreover capable of being screwed onto the actuating part 6 by means of inner and outer screw threads 18, 19.

Figure 6:
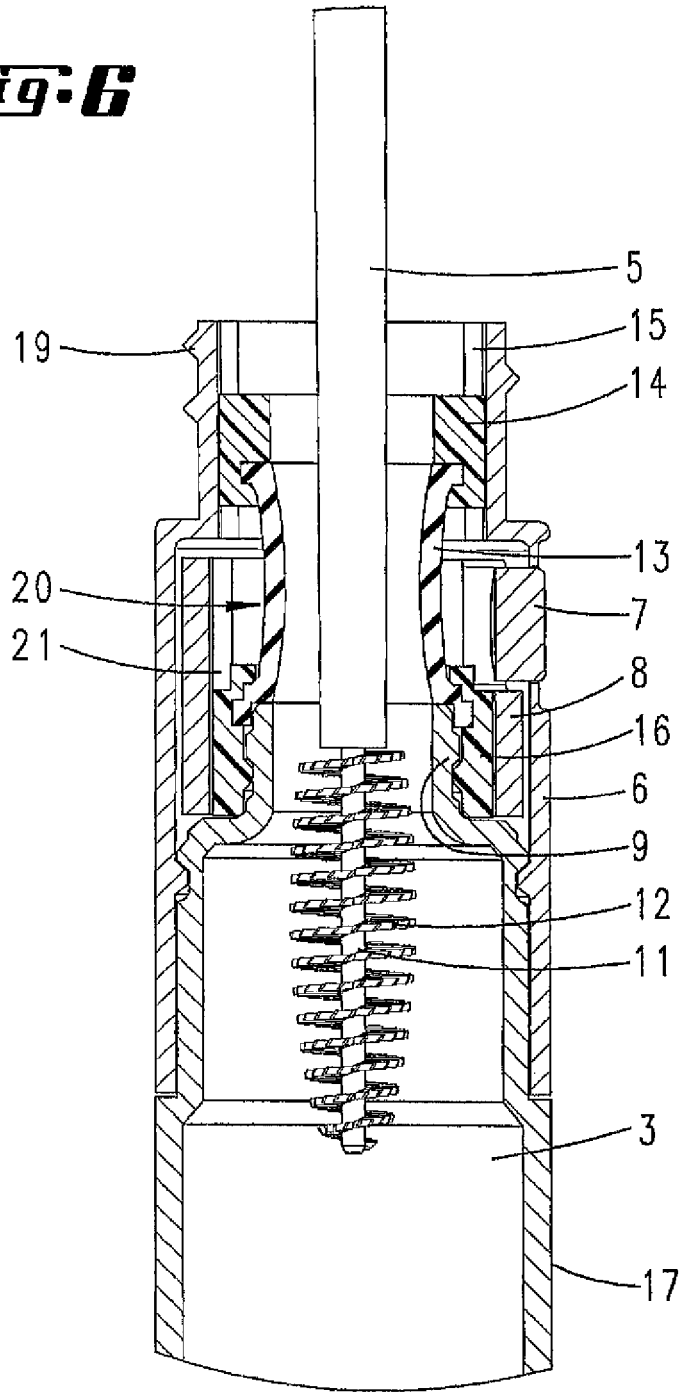
FIG. 6 shows an illustration corresponding to FIG. 4, but with the removal part partly withdrawn, in a first setting of opening width for the wiping device.
Figure 7:
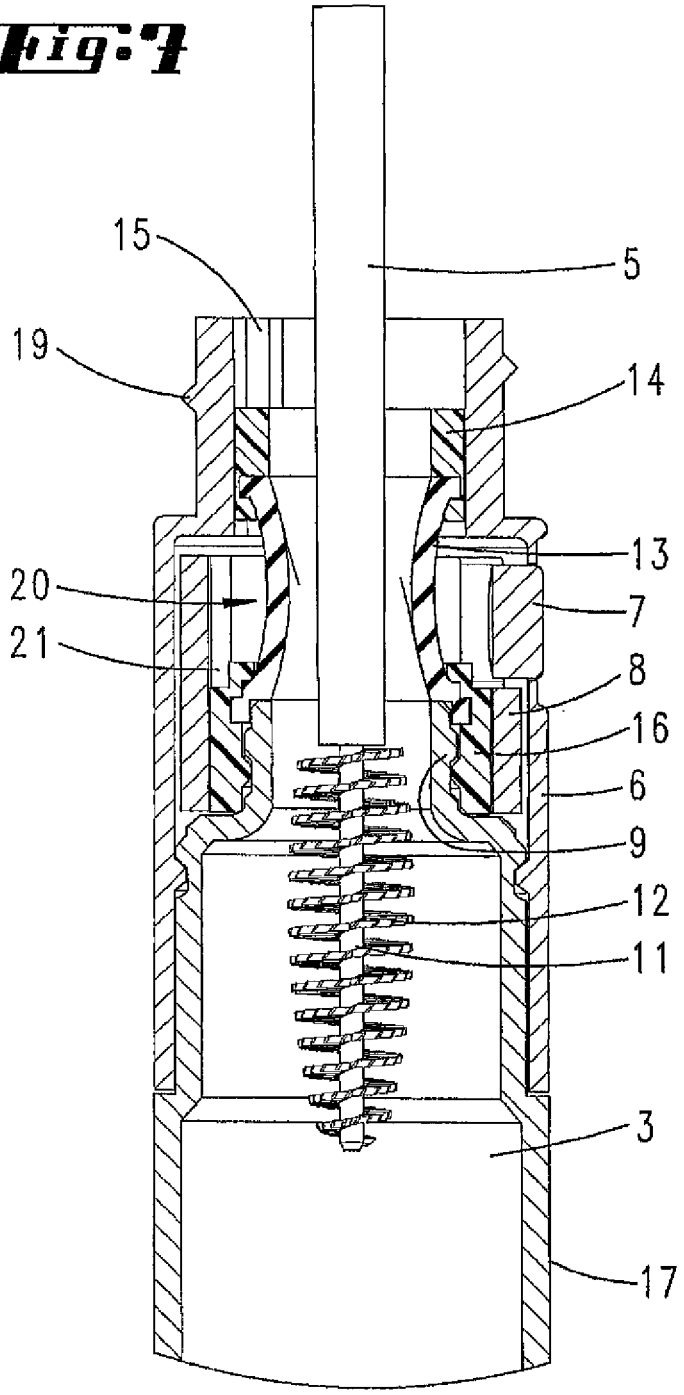
FIG. 7 shows an illustration corresponding to FIG. 6, in a second setting of opening width for the wiping part.
Figure 8:
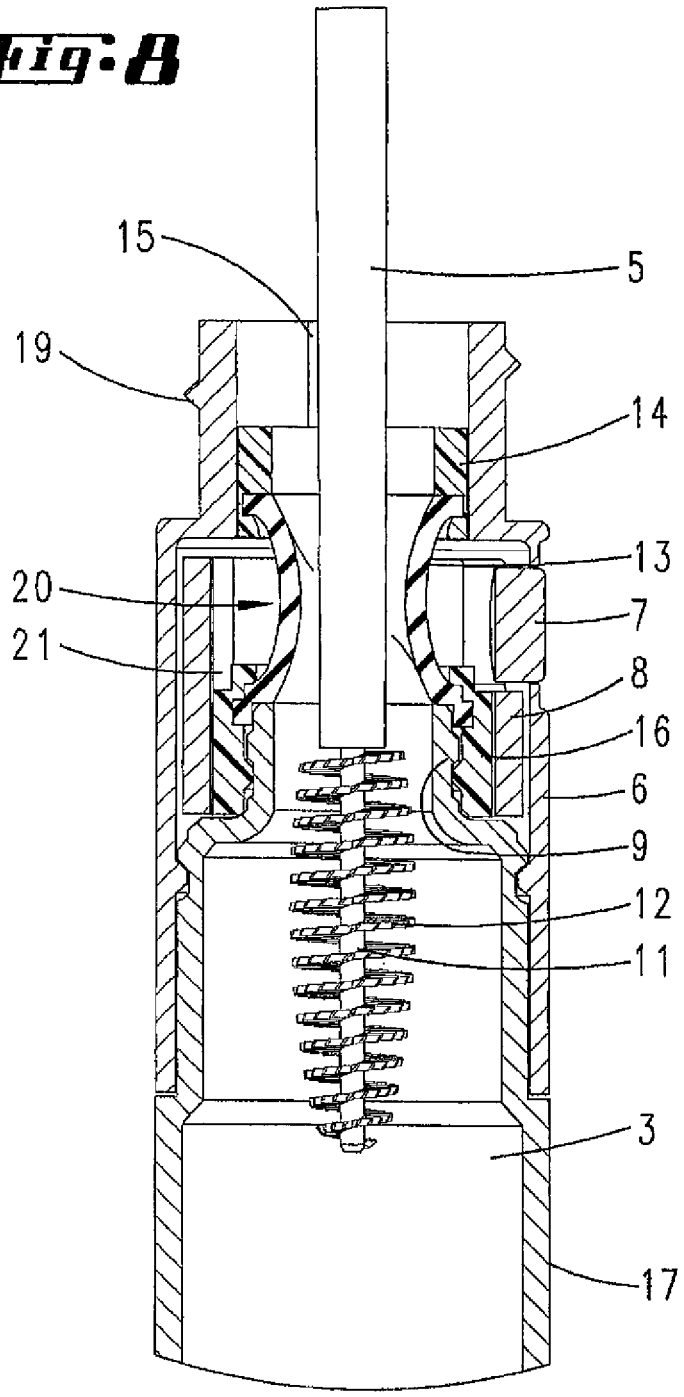
FIG. 8 shows a further illustration corresponding to FIG. 6 and FIG. 7, in a still narrower setting of opening width for the wiping part.
Figure 9:
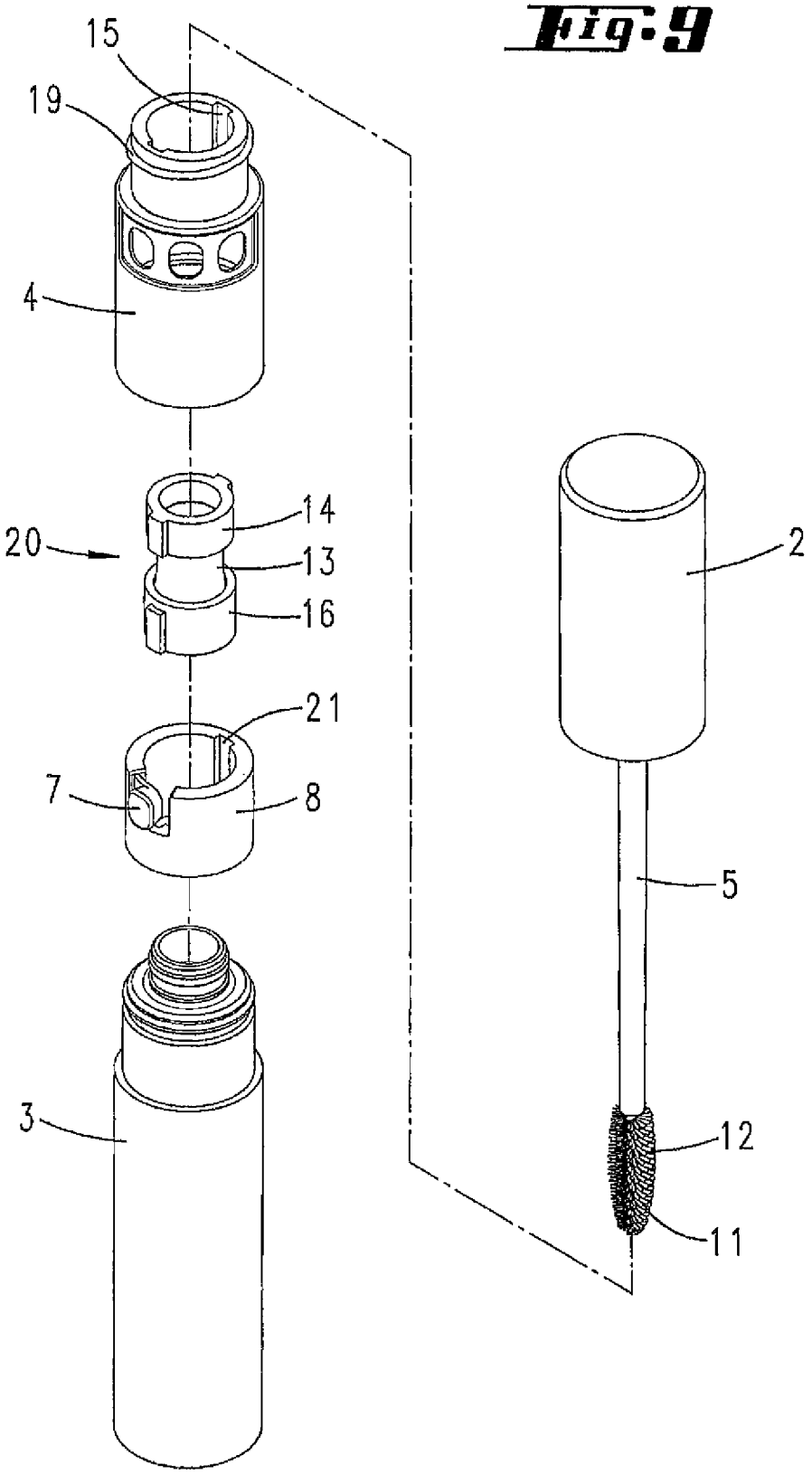
FIG. 9 shows an exploded illustration of the receptacle.

The latching cam part 8 is held in a rotationally-fixed manner on the base part 16 by means of guides 21. The adjustment of the wiping device is effected basically by the ends of the wiping part, which here equates to the part that is passed through, being rotated in opposite directions. For this, one end, preferably the base part 16, is connected to the storage part 3 in a rotationally-fixed manner. The upper end, preferably the mounting end 14 of the wiping part, is coupled to the actuating part 6 for rotation therewith. A rotation of the actuating part 6 relative to the storage part 3 thus brings about at the same time a rotation of the upper region of the wiping part 13 relative to its base part 16. By virtue of this, there comes about a change in the constriction (FIGS. 6 to 8).

As regards use, matters proceed as follows:

First of all, a wiping setting is selected in the closed condition according to FIG. 1. For this, the receptacle is held firmly in the lower region, the latch knob 7 is then pressed in, and the actuating part 6 is rotated relative to the storage part 3 until the desired setting is reached and this setting is secured again by the latch knob 7. The protective cap 2 and the removal part 5 located on it can then be withdrawn. The bristles 12 are, by virtue of this, impregnated with the product, or product adheres to the bristles, the product not being shown in detail. By withdrawing the removal part 5, the bristles 12 necessarily travel through the wiping part 13 in one of the positions shown in the FIGS. 4 and 6 to 8. According to the setting selected, more or [less] product is wiped off and remains in the receptacle. The withdrawn removal part can then be used for application of the product in the usual manner.

LIST OF REFERENCE SIGNS

1 receptacle
2 protective cap
3 storage part
4 adjustment part
5 removal part
6 actuating part
7 latching cam, latch knob
8 latching cam part
9 neck region
10 handle end
11 removal tip
12 bristles
13 wiping part (elastomer part)
14 mounting portion
15 guide
16 base part
17 outer surface
18 outer thread
19 outer thread
20 wiping device
21 guide

The invention claimed is:

1. Receptacle for a liquid or pasty cosmetic product, the receptacle having a removal part, a storage space part and a storage space for the cosmetic product, the removal part being introducible into the storage space and being withdrawable by being brought through a wiping device, which has an opening having a free opening area, wherein the free opening area can be altered, and the receptacle having an adjustment part, which is accessible for a user from outside the receptacle and enables the action of the wiping device in order to adjust a wiping effect, wherein the wiping device has a part configured to wipe the removal part and to be loaded with the cosmetic product from the removal part when the removal part is passed through, the part being connected with a first connection to the storage space part in a rotationally fixed manner and with a second connection to the adjustment part, wherein the second connection is rotationally and axially displaceable, and wherein the storage space part has a first end in a pullout direction of the receptacle and the part of the wiping device is connected to the first end of the storage space part.

2. Receptacle according to claim 1, wherein the opening is formed by a cylindrical region which is passed through.

3. Receptacle according to claim 2, wherein the cylindrical region which is passed through has a degree of constriction, and wherein the degree of constriction can be changed.

4. Receptacle according to claim 2, wherein the cylindrical region which is passed through is formed from an elastic material.

5. Receptacle according to claim 2, wherein the cylindrical region which is passed through is formed from an elastic material.

6. Receptacle according to claim 1, wherein the adjustment part can be displaced relative to the storage space part.

7. Receptacle according to claim 1, wherein the adjustment part is rotatable.

8. Receptacle according to claim 6, wherein the adjustment part is latchingly displaceable relative to the storage space part.

* * * * *